United States Patent [19]

Wise et al.

[11] Patent Number: 4,657,693

[45] Date of Patent: Apr. 14, 1987

[54] SPRAY-DRIED GRANULAR DETERGENT COMPOSITIONS CONTAINING TRIPOLYPHOSPHATE DETERGENT BUILDER, POLYETHYLENE GLYCOL AND POLYACRYLATE

[75] Inventors: Rodney M. Wise, Cincinnati; Robert R. Ziek, Jr., Mariemont, both of Ohio

[73] Assignee: The Procter & Gamble Company, Cincinnati, Ohio

[21] Appl. No.: 814,021

[22] Filed: Dec. 23, 1985

Related U.S. Application Data

[63] Continuation of Ser. No. 664,905, Oct. 26, 1984, abandoned.

[51] Int. Cl.[4] ..... C11D 11/00

[52] U.S. Cl. ..... 252/174.21; 252/135; 252/174.24

[58] Field of Search ..... 252/135, 174.21, 174.24, 252/DIG. 5

[56] References Cited

U.S. PATENT DOCUMENTS

| | | | |
|---|---|---|---|
| 2,220,099 | 11/1940 | Guenther et al. | 260/505 |
| 2,477,383 | 7/1949 | Lewis | 252/161 |
| 3,284,364 | 11/1966 | Siegle | 252/132 |
| 3,329,616 | 7/1967 | Feierstein et al. | 252/138 |
| 3,509,059 | 4/1970 | Renold | 252/135 |
| 3,558,499 | 1/1971 | Galvin et al. | 252/137 |
| 3,563,903 | 2/1971 | Schmadel | 252/152 |
| 3,563,904 | 2/1971 | Schmadel | 252/152 |
| 3,664,961 | 5/1972 | Norris | 252/99 |
| 3,708,436 | 1/1973 | Thompson et al. | 252/527 |
| 3,721,627 | 3/1973 | Adams et al. | 252/89 |
| 3,794,605 | 2/1974 | Diehl . | |
| 3,824,189 | 7/1974 | Borello | 252/99 |
| 3,904,685 | 9/1975 | Shahidi | 260/537 N |
| 3,922,230 | 11/1975 | Lamberti et al. . | |
| 3,933,673 | 1/1976 | Davies . | |
| 3,957,695 | 5/1976 | Davies et al. | 252/532 |
| 4,031,022 | 6/1977 | Vogt et al. . | |
| 4,072,621 | 2/1978 | Rose . | |
| 4,144,226 | 3/1979 | Crutchfield et al. | 528/231 |
| 4,180,485 | 12/1979 | Llenado | 252/532 |
| 4,222,905 | 9/1980 | Cockrell, Jr. | 252/547 |
| 4,239,659 | 12/1980 | Murphy | 252/524 |
| 4,283,299 | 8/1981 | Becker et al. | 252/90 |
| 4,325,829 | 4/1982 | Dugglesby et al. . | |
| 4,379,080 | 4/1983 | Murphy | 252/526 |
| 4,436,644 | 3/1984 | Johnson et al. | 252/174.13 |
| 4,490,271 | 12/1984 | Spadini et al. . | |

FOREIGN PATENT DOCUMENTS

| | | |
|---|---|---|
| 1333915 | 10/1973 | United Kingdom . |
| 1380402 | 1/1975 | United Kingdom . |
| 1460893 | 1/1977 | United Kingdom . |
| 2048841 | 12/1980 | United Kingdom . |

*Primary Examiner*—Paul Lieberman
*Assistant Examiner*—Willie J. Thompson
*Attorney, Agent, or Firm*—Robert B. Aylor; Richard C. Witte; Thomas H. O'Flaherty

[57] ABSTRACT

Detergent compositions comprising a mixture of polyethylene glycol and polyacrylate of specified molecular weight for improved physical properties and cold water dispersion are disclosed.

16 Claims, No Drawings

SPRAY-DRIED GRANULAR DETERGENT COMPOSITIONS CONTAINING TRIPOLYPHOSPHATE DETERGENT BUILDER, POLYETHYLENE GLYCOL AND POLYACRYLATE

This is a continuation of Ser. No. 664,905, filed on Oct. 26, 1984, now abandoned.

TECHNICAL FIELD

The present invention relates to spray-dried, granular detergent compositions.

SUMMARY OF THE INVENTION

The present invention encompasses a spray dried granular detergent composition comprising:

(a) from about 5% to about 50% by weight of a nonsoap anionic detergent surfactant;

(b) from about 20% to about 60% by weight of an alkali metal tripolyphosphate detergent builder;

(c) from about 1% to about 10% of a mixture of a polyethylene glycol and a polyacrylate, said mixture having a polyethylene glycol:polyacrylate weight ratio of from about 1:10 to about 10:1, said polyethylene glycol having a weight average molecular weight of from about 1,000 to about 50,000, and said polyacrylate having a weight average molecular weight of from about 1,000 to about 20,000.

DETAILED DESCRIPTION OF THE INVENTION

The detergent compositions of the present invention contain a nonsoap anionic detergent surfactant, a water-soluble alkali metal tripolyphosphate detergent builder, and a mixture of a polyacrylate polymer of selected molecular weight and a polyethylene glycol of selected molecular weight. The polyacrylate/polyethylene glycol mixtures herein provides a surprising boost to dispersion rates in cold water and improvement in physical properties.

The compositions of the present invention are prepared by spray drying and have superior physical characteristics.

Surfactant

The detergent compositions herein contain from about 5% to about 50%, preferably from about 10% to about 30% of a nonsoap anionic surfactant, or mixtures thereof. Surfactants useful herein are listed in U.S. Pat. No. 3,664,961, Norris, issued May 23, 1972, and in U.S. Pat. No. 3,929,678, Laughlin et al, issued Dec. 30, 1975, both incorporated herein by reference.

Useful anionic surfactants include the water-soluble salts, preferably the alkali metal salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil; and the sodium and potassium alkylbenzene sulfonates in which the alkyl group contains from about 9 to about 15 carbon atoms, in straight chain or branched chain configuration, e.g., those of the type described in U.S. Pat. Nos. 2,220,099 and 2,477,383 both of which are incorporated herein by reference. Especially valuable are linear straight chain alkylbenzene sulfonates in which the average number of carbon atoms in the alkyl group is from about 11 to 13, abbreviated as $C_{11-13}$LAS.

Other anionic surfactants suitable for use herein are the sodium alkyl glyceryl ether sulfonates, especially those ethers of higher alcohols derived from tallow and coconut oil; sodium coconut oil fatty acid monoglyceride sulfonates and sulfates; sodium or potassium salts of alkyl phenol ethylene oxide ether sulfates containing from about 1 to about 10 units of ethylene oxide per molecule and from about 8 to about 12 carbon atoms in the alkyl group; and sodium or potassium salts of alkyl ethylene oxide ether sulfates containing from about 1 to about 10 units of ethylene oxide per molecule and from about 10 to about 20 carbon atoms in the alkyl group.

Other useful anionic surfactants include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acryl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin or paraffin sulfonates containing from about 12 to 18 carbon atoms; and beta-alkyloxy alkane sulfonates containing from about 1 to about 3 carbon atoms in the alkyloxy group and from about 8 to about 20 carbon atoms in the alkane moiety.

Particularly preferred surfactants for use herein include sodium $C_{11-13}$LAS, $C_{14-18}$ alkyl sulfates, $C_{14-18}$ alkyl linear polyethoxy sulfates containing from about 1 to about 4 moles of ethylene oxide, and mixtures thereof.

The Detergent Builder

The compositions of the present invention contain from about 20% to about 60%, preferably from about 30% to about 50%, by weight of an alkali metal tripolyphosphate, preferably sodium tripolyphosphate.

Polyethylene Glycol/Polyacrylate

The compositions of the present invention contain from about 1% to about 10%, preferably from about 1.5% to about 8% of a mixture of a polyethylene glycol and a polyacrylate. The polyethylene glycol and the polyacrylate are present in a weight ratio of from about 1:10 to about 10:1, preferably from about 1:3 to about 3:1. The polyethylene glycol has a weight average molecular weight of from about 1,000 to about 50,000, preferably from about 4,000 to about 20,000. The polyacrylate has a weight average molecular weight of from about 1,000 to about 20,000, preferably from about 2,000 to about 10,000, more preferably from about 3,000 to about 8,000.

While polyethylene glycols are preferred, other suitable polymeric materials are the condensation products of $C_{10-20}$ alcohols or $C_{8-18}$ alkyl phenols with sufficient ethylene oxide, i.e., more than 50% by weight of the polymer, so that the resultant product has a melting point above about 35° C.

Preferred polymers contain at least about 70% ethylene oxide by weight and more preferred polymers contain at least about 80% ethylene oxide by weight. Preferred polymeric materials have HLB values of at least about 15, and more preferably at least about 17. Block and heteric polymers based on ethylene oxide and propylene oxide addition to a low molecular weight organic compound containing one or more active hydrogen atoms are suitable in the practice of the invention. Polymers based on the addition of ethylene oxide and propylene oxide to propylene glycol, ethylenediamine, and trimethylolpropane are commercially available under the names Pluronics ®, Pluronic ® R, Tetronics ® and Pluradots ® from the BASF Wyandotte Corporation of Wyandotte, Mich. Corresponding nonproprietary names of the first three trade names are poloxamer, meroxapol and poloxamine, respectively.

Optimum solubility of the polyacrylate is obtained when it is in the form of an at least partially neutralized alkali metal salts. The sodium salts are most preferred.

Suitable polyacrylates herein are the partially or fully neutralized salts of polymers of acrylic acid. One can also use copolymers formed with small amounts of other copolymerizable monomers. The percentage by weight of the polyacrylate units which is derived from acrylic acid is preferably greater than about 80%. Suitable copolymerizable monomers include, for example, methacrylic acid, hydroxyacrylic acid, vinyl chloride, vinyl alcohol, furan, acrylonitrile, methacrylonitrile, vinyl acetate, methyl acrylate, methyl methacrylate, styrene, alpha-methylstyrene, vinyl methyl ether, vinyl ethyl ether, vinyl propyl ether, acrylamide, ethylene, propylene and 3-butenoic acid. Mixtures of these polymers can also be used. The polyacrylate may also be added in the acid form and neutralized by various bases present.

Preferred copolymers of the above group contain at least about 90% by weight of units derived from the acrylic acid. Preferably essentially all of the polymer is derived from acrylic acid. Particularly preferred is sodium polyacrylate, especially when it is has an average molecular weight of from about 3,000 to about 8,000.

It is essential that this mixture be added in the crutcher rather than post dosed for the benefits of the invention to be seen.

Optional Ingredients

The compositions of the invention can additionally contain up to 10%, preferably about 5% of an organic surfactant selected from the group consisting of nonionic, zwitterionic, ampholytic, and cationic surfactants and mixtures thereof. The compositions can also contain other conventional ingredients, such as nonphosphorous builders, either organic or inorganic in nature.

Useful nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to about 15 carbon atoms, in either a straight chain or branched chain configuration, with from about 3 to about 12 moles of ethylene oxide per mole of alkyl phenol.

Preferred nonionics are the water-soluble condensation products of aliphatic alcohols containing from about 8 to about 22 carbon atoms, in either straight chain or branched configuration, with from about 3 to about 12 moles of ethylene oxide per mole of alcohol. Particularly preferred are the condensation products of alcohols having an alkyl group containing from about 9 to about 15 carbon atoms with from about 4 to about 8 moles of ethylene oxide per mole of alcohol.

Suitable semi-polar nonionic surfactants include: (2) water-soluble amine oxides containing one alkyl moiety of from about 10 to about 18 carbon atoms and 2 moieties selected from the group consisting of alkyl groups and hydroxyalkyl groups containing from about 1 to about 3 carbon atoms, (2) water-soluble phosphine oxides containing one alkyl moiety of about 10 to about 18 carbon atoms and 2 moieties selected from the group consisting of alkyl groups and hydroxyalkyl groups containing from about 2 to 3 carbon atoms and (3) water-soluble sulfoxides containing one alkyl moiety of from about 10 to about 18 carbon atoms and a moiety selected from the group consisting of alkyl and hydroxyalkyl moieties of from about 1 to about 3 carbon atoms.

Optional ampholytic surfactants include derivatives of aliphatic, or aliphatic derivatives of heterocyclic, secondary and tertiary amines in which the aliphatic moiety can be straight chain, or branched, and wherein one of the aliphatic substituents contains from about 8 to about 18 carbon atoms and at least one aliphatic substituent contains an anionic water-solubilizing group.

Useful cationic surfactants include those described in U.S. Pat. No. 4,222,905, Cockrell, issued Sept. 16, 1980, and in U.S. Pat. No. 4,239,659, Murphy, issued Dec. 16, 1980, both incorporated herein by reference.

Optional zwitterionic surfactants include derivatives of aliphatic quaternary ammonium or phosphonium or ternary sulfonium compounds in which one of the aliphatic substituents contains from about 8 to about 18 carbon atoms.

Also useful in the compositions of the invention are alkylpolysaccharide surfactants. The preferred alkylpolyglycosides have the formula $RO(C_nH_{2n}O)_t$(-glycosyl)$_x$ wherein R is selected from the group consisting of alkyl, alkylphenyl, hydroxyalkyl, hydroxyalkylphenyl and mixtures thereof, in which said alkyl groups contain from about 10 to about 18, preferably from about 12 to about 14 carbon atoms, n is 2 or 3, preferably 2, t is from 0 to about 10, preferably 0, and x is about 1-$\frac{1}{2}$ to about 10, preferably from about 1-$\frac{1}{2}$ to about 3, preferably from about 1.6 to about 2.7. The glycosyl is preferably derived from glucose.

The detergent compositions of the invention can optionally contain water-insoluble aluminosilicate ion exchange material of the formula $$Na_z[(AlO_2)_z.(SiO_2)_y].xH_2O$$

wherein z and y are at least about 6, the molar ratio of z to y is from about 1.0 to about 0.5 and x is from about 10 to about 264. Amorphous hydrated aluminosilicate materials useful herein have the empirical formula $$M_z(zAlO_2.ySiO_2)$$

wherein M is sodium, potassium, ammonium or substituted ammonium, z is from about 0.5 to about 2 and y is 1, said material having a magnesium ion exchange capacity of at least about 50 milligram equivalents of $CaCO_3$ hardness per gram of anhydrous aluminosilicate.

The aluminosilicate ion exchange builder materials herein are in hydrated form and contain from about 10% to about 28% of water by weight if crystalline, and potentially even higher amounts of water if amorphous. Highly preferred crystalline aluminosilicate ion exchange materials contain from about 18% to about 22% water in their crystal matrix. The crystalline aluminosilicate ion exchange materials are further characterized by a particle size diameter of from about 0.1 micron to about 10 microns. Amorphous materials are often smaller, e.g., down to less than about 0.01 micron. Preferred ion exchange materials have a particle size diameter of from about 0.2 micron to about 4 microns. The term "particle size diameter" herein represents the average particle size diameter of a given ion exchange material as determined by conventional analytical techniques such as, for example, microscopic determination utilizing a scanning electron microscope. The crystalline aluminosilicate ion exchange materials herein are usually further characterized by their calcium ion exchange capacity, which is at least about 200 mg. equivalent of $CaCO_3$ water hardness/g. of aluminosilicate, calculated on an anhydrous basis, and which generally is in the range of from about 300 mg. eq./g. to about 352 mg. eq./g. The aluminosilicate ion exchange materials herein are still further characterized by their calcium exchange rate which is at least about 2 grains $Ca^{++}$/gallon/minute/gram/gallon of aluminosilicate (anhydrous basis), and generally lies within the range of from about 2 grains/gallon/minute/gram/gallon to about 6 grains/gallon/minute/gram/gallon, based on calcium ion hardness. Optimum aluminosilicate for builder purposes exhibit a calcium ion exchange rate of at least about 4 grains/gallon/minute/gram/gallon.

The amorphous aluminosilicate ion exchange materials usually have a $Mg^{++}$ exchange capacity of at least about 50 mg. eq. $CaCO_2$/g. (12 mg. $Mg^{++}$/g.) and a $Mg^{++}$ exchange rate of at least about 1 grain/gallon/minute/gram/gallon. Amorphous materials do not exhibit an observable diffraction pattern when examined by Cu radiation (1.54 Angstrom Units).

Aluminosilicate ion exchange material useful in the practice of this invention are commercially available. The aluminosilicates useful in this invention can be crystalline or amorphous in structure and can be naturally-occurring aluminosilicates or synthetically derived. A method for producing aluminosilicate ion exchange materials is discussed in U.S. Pat. No. 3,985,669, Krummel, et al, issued Oct. 12, 1976, incorporated herein by reference. Preferred synthetic crystalline aluminosilicate ion exchange materials useful herein are available under the designations Zeolite A, Zeolite B, and Zeolite X. In an especially preferred embodiment, the crystalline aluminosilicate ion exchange material has the formula $$Na_{12}[AlO_2)_{12}(SiO_2)_{12}].xH_2O$$

wherein x is from about 20 to about 30, especially about 27.

Water-soluble, nonphosphorus organic builders useful herein include the various alkali metal, ammonium and substituted ammonium, carboxylates, nonpolymeric polycarboxylates and polyhydroxysulfonates. Examples of nonpolymeric polycarboxylate builders are the sodium, potassium, lithium, ammonium and substituted ammonium salts of ethylenediaminetetraacetic acid, nitrilotriacetic acid, oxydisuccinic acid, mellitic acid, benzene polycarboxylic acids, and citric acid. The compositions of this invention only contain the limited amount of polyacrylate defined hereinafter.

Other useful builders herein are sodium and potassium carboxymethyloxymalonate, carboxymethyloxysuccinate, cis-cyclohexanehexacarboxylate, cis-cyclopentanetetracarboxylate, and phloroglucinol trisulfonate.

Other suitable nonpolymeric polycarboxylates are the polyacetal carboxylates described in U.S. Pat. No. 4,144,226, issued Mar. 13, 1979 to Crutchfield, et al, and U.S. Pat. No. 4,146,495, issued Mar. 27, 1979 to Crutchfield, et al, both incorporated herein by reference. These polyacetal carboxylates can be prepared by bringing together under polymerization conditions an ester of glyoxylic acid and a polymerization initiator. The resulting polyacetal carboxylate ester is then attached to chemically stable end groups to stabilize the polyacetal carboxylate against rapid depolymerization in alkaline solution, and converted to the corresponding.

The compositions herein preferably contain from about 0% to about 10%, preferably from about 0.5% to about 8%, and most preferably from about 1% to about 6%, by weight of an alkali metal silicate having a molar ratio of $SiO_2$ to alkali metal oxide of from about 1.0 to about 3.2, preferably from about 1.4 to about 2.4. Sodium silicate, particularly one having a molar ratio of about 1.6 to about 2.2 is preferred.

The alkali metal silicates can be purchased in either liquid or granular form. Silicate slurries can conveniently be used to avoid having to dissolve the dried form in the crutcher mix of the components herein.

Other ingredients commonly used in detergent compositions can be included in the compositions of the present invention. These include color speckles, bleaching agents such as perborates and percarbonates and bleach activators, suds boosters or suds suppressors, antitarnish and anticorrosion agents, soil suspending agents, coil release agents, dyes, fillers, optical brighteners, germicides, pH adjusting agents, nonbuilder alkalinity sources, hydrotropes such a toluene sulfonates and xylene sulfonates, enzymes, enzyme-stabilizing agents, perfumes and water.

The detergent compositions of the present invention can comprise a portion of compositions containing a wide variety of materials suitable for detergent or other uses.

The following nonlimiting examples illustrate the detergent compositions of the present invention.

All percentages, parts, and ratios used herein are by weight unless otherwise specified.

COMPARATIVE EXAMPLE I

A base product was prepared by spray drying according to the following formula.

$NaC_{11-13}$LAS: 8.75
$NaC_{14-15}$ alkyl sulfate: 8.75
Na tripolyphospate: 38.3
Na Silicate solids (1.6r): 5.5
Na sulfate: 13.9
Na Carbonate (dry mixed): 15.5
Na carboxymethylcellulose: 0.35
Ultramarine blue: 0.16
Minor ingredients and water: balance

EXAMPLE II

The base product was produced according to Example I with varying ratios of polyethylene glycol (PEG) with a weight average molecular weight of 8,000 and sodium polyacrylate with weight average molecular weight of 4,500 as shown below added in the crutcher mix. Eight-five grams (85 g.) of product was sewn into black fabric pockets and agitated on delicate agitation at 60° F. (15.5° C.) in a Kenmore washer. Pockets were removed and cut at 5 minutes and 10 minutes and graded on a 1–7 scale where 1 is poorly dispersed with most of the product remaining caked in the pocket and 7 is completely dispersed. Grades reported are averages of two replicate tests.

| Product | % PEG | 4500 mw % polyacrylate | 5 minute grade | 10 minute grade |
|---|---|---|---|---|
| A | 0 | 1.0 | 4.5 | 6.0 |
| B | 0.5 | 1.0 | 6.5 | 7.0 |
| C | 0.6 | 0.5 | 2.5 | 4.0 |
| D | 1.1 | 0 | 2.0 | 2.75 |
| E | 1.1 | 0 | 2.0 | 3.0 |

As can be seen, the products containing both the PEG and polyacrylate of the invention have the most improved cold water dispersion.

EXAMPLES III–VI

A crutcher paste was prepared with the following composition.

| | Weight Percent |
|---|---|
| Surfactant | 27% |
| 1:1 mixture of $NaC_{11-13}$ LAS | |
| $NaC_{14-15}$ alkyl sulfate | |
| Water | 58% |
| Sodium sulfate and unreacted | Balance |

Samples were prepared with the following additive parts to 17.5 parts anionic surfactant. Added water was kept constant at 1.5 parts.

Control—No additives

A—1% PEG 8000

B—1% Polyacrylate

C—1% of a 1:1 mixture of PEG and polyacrylate

The samples were placed in an oven for several hours. Rapid observational comparisons were made of these variants; viscosity, stirred viscosity and phase continuity. A filter paper wicking test was used to indicate whether the lye or surfactant phase was dominant or external (i.e., lye or aqueous phase wicks or wets through immediately while a dominant or continuous surfactant phase slows or prevents wicking).

Top Layer Fluidity
1 - no flow; 3 - stiff, but flows; 5 - fluid, creamy; 7 - watery thin

| Sample Temp (°F.) | Control | A | B | C |
|---|---|---|---|---|
| 72 | 5 | 1 | 5 | 1 |
| 100 | 4 | 6 | 4 | 6 |
| 120 | 5 | 5 | 4 | 6 |
| 140 | 1 | 6 | 4 | 6 |
| 160 | 2 | 7 | 4 | 6 |
| 185 | 2 | 7 | 4 | 7 |

As can be seen, the sample with the mixture of PEG/-polyacrylate was overall less viscous at elevated processing-range temperatures than the control or samples with only PEG or polyacrylate, while remaining crystalline at room temperature. This crystalline property usually translates into crisp, non-sticky free-flowing granules with good physical properties, i.e., storage stability, pourability, and caking resistance.

Fluidity, stirred
1 - thickest; 2 - thick/mayonnaise; 4 - pudding-like; 6 - creamy; 7 - watery/thin

| Sample Temp (°F.) | Control | A | B | C |
|---|---|---|---|---|
| 72 | 4 | 2 | 7 | 1 |
| 100 | 5 | 7 | 7 | 7 |
| 120 | 7 | 7 | 6 | 7 |
| 140 | 2 | 7 | 6 | 7 |
| 160 | 2 | 7 | 6 | 7 |
| 185 | 2 | 7 | 5 | 7 |

Again, the PEG/polyacrylate sample was consistantly a thin fluid at high temperatures, while showing the best stability at room temperature. This increases ease of processing along with increased storage stability of the finished granule.

Phase continuous

| Sample Temp (°F.) | Control | A | B | C |
|---|---|---|---|---|
| 72 | lye | lye | lye | lye |
| 100 | lye | lye | lye | lye |
| 120 | marginal | lye | lye | lye |
| 140 | organic | lye | lye | lye |
| 160 | organic | lye | lye# | lye |
| 185 | organic | lye | lye# | lye |

#Two phase incompatibility (separation)

The sample with the PEG/polyacrylate mixture showed desirable phase continuity. A dominent or external lye phase is desirable as it translates into non-sticky free flowing finished granules and more rapid dissolution or dispersion in wash water.

When taken together, the results of the paste tests clearly show that the PEG/polyacrylate mixture shows better physical characteristics in the paste form. These would translate into better physical characteristics such as storage stability and caking resistance in the finished granular product.

What is claimed is:

1. A spray-dried granular detergent composition comprising:

(a) from about 5% to about 50% of a nonsoap anionic surfactant or mixtures thereof;

(b) from about 20% to about 60% of an alkali metal tripolyphosphate builder or mixtures thereof;

(c) from about 1% to about 10% of a mixture of polyethylene glycol and a polyacrylate, said mixture having a polyethylene glycol to polyacrylate weight ratio of from about 1:3 to about 3:1, said polyethylene glycol having a weight average molecular weight of from about 1,000 to about 50,000, and said polyacrylate having a weight average molecular weight of from about 1,000 to about 20,000.

2. The composition of claim 1 wherein the mixture of polyethylene glycol and polyacrylate comprises from about 1% to about 3% of the composition.

3. The composition of claim 2 wherein the polyacrylate has a weight average molecular weight of from about 2,000 to about 10,000.

4. The composition of claim 3 wherein the polyethylene glycol has a weight average of from about 4,000 to about 20,000, and the polyacrylate has a weight average molecular weight of from about 3,000 to about 8,000.

5. The composition of claim 4 wherein the polyacrylate is sodium polyacrylate.

6. The composition of claim 1 wherein the mixture of polyethylene glycol and polyacrylate are present in a weight ratio of from about 1:3 to about 3:1.

7. The composition of claim 1 wherein the polyacrylate has a weight average molecular weight of from about 3,000 to about 8,000, and the polyethylene glycol has a weight average molecular weight of from about 4,000 to about 20,000.

8. The composition of claim 1 wherein the polyacrylate is sodium polyacrylate.

9. The composition of claim 1 wherein the alkali metal tripolyphosphate builder is sodium tripolyphosphate.

10. The composition of claim 9 wherein the nonsoap anionic surfactant comprises a surfactant selected from the group consisting of alkali metal salts of $C_{11-13}$ alkylbenzene sulfonates, $C_{14-18}$ alkyl sulfates, $C_{14-18}$ alkyl polyethoxy sulfates containing from about 1 to about 4 moles of ethylene oxide and mixtures thereof.

11. The composition of claim 10 comprising from about 10% to about 30% of the nonsoap anionic surfactant.

12. The composition of claim 9 additionally comprising from about 1% to about 8% by weight of an alkali metal silicate having a molar ratio of from about 1.6 to about 2.4.

13. The composition of claim 12 comprising from about 1% to about 3% of a mixture of a polyethylene glycol and sodium polyacrylate, said mixture having a polyethylene glycol to sodium polyacrylate weight ratio of from about 1:3 to about 3:1, said polyethylene glycol having a weight average molecular weight of from about 4,000 to about 20,000 and said sodium polyacrylate having a weight average molecular weight of from about 3,000 to about 8,000.

14. A process for spray drying a granular detergent composition comprising:

(a) from about 5% to about 50% of a nonsoap anionic surfactant or mixtures thereof;

(b) from about 20% to about 60% of an alkali metal tripolyphosphate builder or mixtures thereof;

(c) from about 1% to about 10% of a mixture of polyethylene glycol and a polyacrylate wherein the polyethylene glycol and polyacrylate are present in a weight ratio of from about 1:3 to about 3:1 and, wherein the components are mixed in the crutcher along with enough additional water so that the water content of the crutcher paste is from about 25% to about 50% and then spray dried with an inlet air temperature of from about 400° F. (204° C.) to about 800° F. (427° C.).

15. The process of claim 14 wherein the water content of the crutcher paste is from about 28% to about 40% and the inlet air temperature in the spray tower is from about 500° F. (260° C.) to about 700° F. (371° C.).

16. A granular composition prepared by the process of claim 14.

* * * * *